United States Patent [19]

Youdelis

[11] 4,124,380

[45] Nov. 7, 1978

[54] SILVER-COPPER-GERMANIUM ALLOYS HAVING HIGH OXIDATION RESISTANT MELTS

[76] Inventor: William V. Youdelis, 1935 W. Grand Blvd., Windsor, Ontario, Canada, N9E 1G6

[21] Appl. No.: 809,764

[22] Filed: Jun. 24, 1977

[51] Int. Cl.[2] ..... C22C 5/00

[52] U.S. Cl. ..... 75/173 C; 75/134 G; 75/173 R

[58] Field of Search ..... 75/173 R, 173 C, 172 G, 75/172 R, 134 G, 153, 134 N

[56] References Cited

U.S. PATENT DOCUMENTS

| | | | |
|---|---|---|---|
| 1,963,085 | 6/1934 | Gray | 75/173 C |
| 2,196,302 | 4/1940 | Hensel et al. | 75/173 C |
| 3,811,876 | 5/1974 | Harigaya | 75/173 C |
| 3,997,330 | 12/1976 | Aliotta | 75/173 C |

*Primary Examiner*—L. Dewayne Rutledge
*Assistant Examiner*—Peter K. Skiff
*Attorney, Agent, or Firm*—Stevens, Davis, Miller & Mosher

[57] ABSTRACT

A silver-copper-germanium base alloy is disclosed consisting by weight of 40 to 85% silver, 15 to 60% copper and 0.1 to 10% germanium. Optionally, up to 15% by weight of the base alloy may be replaced with tin and up to 10% by weight of at least one of gold, palladium and platinum. The presence of germanium in the alloy virtually eliminates oxidation of the melt during the melting and casting of the alloy and thereby also improves resistance to tarnishing when the alloy is used in an oral environment.

8 Claims, No Drawings

SILVER-COPPER-GERMANIUM ALLOYS HAVING HIGH OXIDATION RESISTANT MELTS

The present invention relates to alloys which are composed essentially of silver, copper, and germanium, such combination hereinafter referred to as the base alloy, and optionally to the base alloys containing tin and varying amounts of precious metals, as for example, gold, palladium and platinum.

Conventional cast or wrought dental alloys, such as those used for inlays, crowns, bridges, and partial dentures, usually contain over 45% by weight of at least one of the precious metals: gold, palladium and platinum, which impart to the alloy the properties of high toughness, the ability to be easily fabricated and good corrosion resistance. Because of the high precious metal content in these types of alloys, the costs for preparing these alloys due to the present high cost of the metals is becoming exorbitant; thus one of the objects of the present invention is to provide new compositions of dental alloys which contain either no precious metals or which have a much lower amount of the precious metals than conventional alloys.

The term "precious metal" as used herein is applicable to gold, palladium and platinum only or to combinations of two or all of these metals.

The base alloys of silver-copper-germanium of this present concept exhibit excellent casting properties as well as ease of fabricating, a hardness that increases with solidification rate and virtually no tendency to oxidation in the liquid state. The base alloys of the present invention have been found to generally have fair corrosion resistance and properties which are desirable for some types of cast alloys employed in dentistry.

I have found that the addition of small to moderate amounts of germanium to silver-copper alloys to produce the present base alloy virtually eliminates oxidation of the melt during the melting and casting of the alloy and furthermore the presence of germanium markedly improves the castability of the alloy. In addition, the silver-copper alloys containing germanium, exhibit an improved resistance to tarnishing in an oral environment. These beneficial results due to germanium are obtained with little or no loss of the excellent fabricating characteristic of silver-copper alloys, when the amount of germanium does not exceed ten percent.

Thus, in accordance with the present invention a base alloy of silver-copper-germanium is provided consisting essentially of, by weight, 40 to 85% silver, 15 to 60% copper and 0.1 to 10% germanium, the base alloy of silver-copper-germanium optionally being replaced up to 15% by weight of tin and up to 10% by weight of at least one of the precious metals consisting of gold, palladium and platinum.

The beneficial effects of germanium additions to the silver-copper alloys are noticeable even in concentrations as low as 0.1% by weight; however the preferred amount of germanium which is present in the alloy is in the range of 0.5% to 2% by weight for alloys which are rich in silver and up to 10% by weight of germanium for alloys which are rich in copper. The addition of the germanium does not significantly affect toughness nor the working ability of the alloy. One of the main beneficial effects imparted to silver-copper alloys by the addition of germanium is that virtual elimination of oxidation of the alloy is obtained during melting and casting. The protection against oxidation of copper in the alloy results from the preferred oxidation of germanium and the simultaneous sublimation of the germanium oxide (GeO) as it forms. At approximately 710° C., solid germanium oxide transforms directly to the gaseous state at one atmosphere pressure, the pressure of the vapour increasing exponentially with temperature. Eutectic or near-eutectic silver-copper alloys which would correspond to approximately 72 parts of silver to 28 parts copper by weight, melt at a temperature of approximately 780° C. Any oxygen penetrating the alloy melt containing germanium is immediately and vigorously expelled as gaseous germanium oxide at a pressure considerably exceeding one atmosphere. Furthermore, as a result of the sublimation process, a protective blanket of gaseous germanium oxide is formed which prevents or significantly decreases the amount of atmospheric oxygen from reaching the surface of the melt. The result is a virtually oxide-free casting when germanium is present which is in direct contrast to the black oxide surface that invariably develops during the melting and casting of silver-copper alloys which contain no germanium.

The excellent casting ability of the silver-copper-germanium alloys of the present invention is believed due to the virtual absence of any oxide films on the melt surface and also due to the high surface tension as indicated by the tendency of the alloy melt to ball or spherodize. The high surface tension of the alloy melt is associated with the vaporization of the germanium oxide at the melt-air interface. In general, an increase in surface tension of a melt results in a corresponding decrease in the tendency of the melt to wet surfaces which improves flow and thereby improves the casting ability of the alloy.

The hardness of the base alloy of silver-copper-germanium composition of the present invention, in particular the preferred alloy in which the silver-copper weight ratio corresponds to the eutectic or near eutectic composition, is directly related to the fineness of the microstructure of the alloy which may be varied from a relatively coarse to an extremely fine lamellar-like structure by increasing the solidification rate of the alloy casting. I have found that for rapid solidification rates and corresponding fine microstructures, such as may be obtained by casting into a mold at room temperature, the cast alloy develops a Vickers hardness of approximately 200 (for a 100 gram load) or higher, and for slow solidification rates and correspondingly coarser microstructures, such as may be obtained by casting into a mold preheated several hundred degrees, the casting develops a Vickers hardness of only about 100 or less.

It has been further found that the addition of germanium in low to moderate amounts does not destroy the characteristically fine lamellar-like microstructure of the eutectic silver-copper alloy when rapidly solidified. When the germanium concentration exceeds about 2% by weight, the microstructure of the alloy tends to coarsen even for high solidification rates. This tends to decrease the hardness of the casting; however this decrease is offset in part by the solid solution hardening effect of the germanium in both the silver-rich and the copper-rich phases of the alloy microstructure. Although many of the specific examples of the alloy composition which are provided herein are eutectic or near eutectic compositions, with a preferred silver to copper weight ratio of about 72 parts of silver to about 28 parts of copper, it will be understood that the present invention provides base alloys of silver-copper-germanium for which the silver to copper weight ratio may vary from about 85:15 to about 40:60.

In accordance with a preferred aspect of the present invention a silver-copper-germanium alloy is provided which exhibits excellent castability, excellent ability to be fabricated, excellent resistance to oxidation of the melt, relatively good resistance to tarnishing in an oral environment and which, in cast form, exhibits a hardness that can be varied over a wide range by a simple technique of varying the solidification rate, the alloy comprising about 70 to 72% by weight silver, 26 to 28% by weight copper and from 0.1 to 2% by weight germanium.

The preferred base alloy of silver-copper-germanium is light gold in color which becomes progressively more silver white in color as the germanium content increases. Increasing the copper content above the eutectic composition tends to redden the color of the alloy.

I have further found that when tin is added to the base alloys of silver-copper-germanium a considerable increase in the hardness of the alloy casting is obtained. For example, the addition of about 10% to about 15% by weight tin to the preferred base alloy of silver-copper-germanium increases the hardness of the casting to approximately 240 Vickers, and such appears to be relatively independent of the solidification rate or microstructure of the alloy. If the tin addition exceeds about 15% by weight, the toughness and fabricability of the alloy is noted to decrease substantially. The addition of tin to the preferred base alloy also lowers the melting point of the alloy by about 100° C. and as such, the tin-containing alloy could be used as a soldering material for base alloys of silver-copper-germanium.

It is thus seen that a silver-copper-germanium-tin composition which contains about 60 to 66% by weight silver, 22 to 27% by weight copper, 0.1 to 2% by weight germanium and 10 to 15% by weight tin provides an alloy which has been found to have good casting properties, high hardness, reasonable ease of fabricating, good resistance to oxidation of the melt, has a melting temperature of about 700° C. and provides a good resistance to tarnishing in an oral environment.

The melting points of the preferred base alloys of silver-copper-germanium and the preferred hardened base alloy containing 10 to 15% by weight of tin can be, if desired, raised by the addition of at least one of the precious metals from the group of gold, palladium and platinum. Thus, I have found that the addition to the preferred base alloy of about 6% by weight tin and about 3% by weight gold to give a composition about: 64% by weight silver, 25% by weight copper, 6% by weight tin, 3% by weight gold, and 2% by weight germanium provides an alloy which has good castability, good hardness, a moderately good resistance to tarnishing in an oral environment, excellent fabricability, high resistance to oxidation of the melt, and has a melting temperature of about 750° C. The addition of the precious metals tends to decrease the tarnish resistance of the alloys in an oral environment, particularly where the precious metal content exceeds 10% by weight of the alloy. This may be associated with the breakdown of the very fine lamellar microstructure of the preferred base alloy to a coarser, two-phase or duplex microstructure which may be more susceptible to galvanic type corrosion; however the addition of up to 10% by weight of gold, palladium or platinum may be employed as an expedient for increasing the melting temperature of the alloy without significantly decreasing the main desirable properties of castability, fabricability or resistance to oxidation of the melt.

For the purposes of illustration and not limitation, the following examples of alloy compositions with the terms of the present invention are provided together with the approximate maximum hardness values and colors:

| Alloy | Composition Weight % | | Hardness Vickers | Color |
|---|---|---|---|---|
| Y-10 | Silver | 71.1 | 195 | white |
| | Copper | 27.6 | | gold |
| | Germanium | 1.3 | | |
| | | 100.0 | | |
| Y-15 | Silver | 67.7 | 170 | white |
| | Copper | 26.3 | | gold |
| | Gold | 4.8 | | |
| | Germanium | 1.2 | | |
| | | 100.0 | | |
| Y-14 | Silver | 61.9 | 240 | silver |
| | Copper | 24.1 | | |
| | Tin | 12.3 | | |
| | Germanium | 1.7 | | |
| | | 100.0 | | |
| Y-25 | Silver | 63.9 | 145 | white |
| | Copper | 24.9 | | gold |
| | Gold | 9.9 | | |
| | Germanium | 1.3 | | |
| | | 100.0 | | |
| Y-20 | Silver | 67.6 | 130 | white |
| | Copper | 26.2 | | gold |
| | Palladium | 5.0 | | |
| | Germanium | 1.2 | | |
| | | 100.0 | | |
| Y-18 | Silver | 64.7 | 185 | light |
| | Copper | 25.2 | | gold |
| | Tin | 6.2 | | |
| | Gold | 2.4 | | |
| | Germanium | 1.5 | | |

In preparing the base alloy of silver-copper-germanium, the germanium may be incorporated into the alloy by one of several methods. It may be added to the alloy melt directly in an essentially pure state or it may be added in the form of an eutectic silver-germanium master alloy containing about 19% germanium by weight. The finished base alloys may be provided in several forms, as for example, rods, sheet, strip, castings, shot, powder or compressed powder tablets. In the powder form, the germanium may be incorporated into the alloy prior to the powdering stage, or it may be admixed as a constituent powder of pure germanium or of a germanium-base alloy into the alloy powders constituting the remaining alloying components.

While the invention has been described with reference to certain specific examples and compositions, it is not necessarily confined to the details as set forth and this application is intended to cover modifications or changes as may come within the scope of the following claims.

The embodiments of the invention in which an exclusive property or privilege is claimed are defined as follows:

1. A base alloy of silver-copper-germanium consisting essentially of 40 to 85% by weight silver, 15 to 60% by weight copper and 0.1 to 10% by weight germanium.

2. The alloy of claim 1 consisting essentially of 70 to 72% by weight silver, 26 to 28% by weight copper and 0.5 to 2% by weight germanium.

3. A base alloy of silver-copper-germanium consisting essentially of 40 to 85% by weight silver, 15 to 60% by weight copper and 0.1 to 10% by weight germanium, said base alloy being replaced by up to 15% by weight tin.

4. The alloy of claim 3 consisting essentially of 60 to 66% by weight silver, 22 to 27% by weight copper, 0.5 to 2% by weight germanium, and 10 to 15% by weight tin.

5. A base alloy of silver-copper-germanium consisting essentially of 40 to 85% by weight silver, 15 to 60% by weight copper, 0.1 to 10% by weight germanium, said base alloy of silver-copper-germanium being replaced by up to 10% by weight of at least one precious metal selected from the group consisting of gold, palladium and platinum.

6. The alloy of claim 5 consisting essentially of 62 to 70% by weight silver, 24 to 27% by weight copper, 0.5 to 2% by weight germanium and up to 10% by weight gold.

7. A base alloy of silver-copper-germanium consisting essentially of 40 to 85% by weight silver, 15 to 60% by weight copper, 0.1 to 10% by weight germanium, said base alloy being replaced by up to 15% by weight tin and by up to 10% by weight of at least one precious metal selected from the group consisting of gold, palladium and platinum.

8. The alloy of claim 7 consisting essentially of 55 to 65% by weight silver, 20 to 25% by weight copper, 5 to 15% by weight tin, 3 to 7% by weight gold, and 0.5 to 2% by weight germanium.

* * * * *